US008049690B2

(12) United States Patent
Wu et al.

(10) Patent No.: US 8,049,690 B2
(45) Date of Patent: Nov. 1, 2011

(54) CIRCUIT AND METHOD FOR DRIVING LIGHT EMITTING DIODES

(75) Inventors: Chin-Lung Wu, Tainan County (TW); Chun-Kai Wang, Tainan County (TW); Kai-Ji Chen, Tainan County (TW)

(73) Assignee: Himax Analogic, Inc., Hsinchu (TW)

( * ) Notice: Subject to any disclaimer, the term of this patent is extended or adjusted under 35 U.S.C. 154(b) by 866 days.

(21) Appl. No.: 12/105,506

(22) Filed: Apr. 18, 2008

(65) Prior Publication Data

US 2009/0207109 A1 Aug. 20, 2009

(30) Foreign Application Priority Data

Feb. 19, 2008 (TW) ..... 97105789 A

(51) Int. Cl.
*G09G 3/32* (2006.01)

(52) U.S. Cl. ..... 345/82; 315/169.3

(58) Field of Classification Search ..... 345/82, 345/83, 204; 315/169.1, 169.3; 362/227, 362/800

See application file for complete search history.

(56) References Cited

U.S. PATENT DOCUMENTS 7,436,378 B2 * 10/2008 Ito et al. ..... 345/82
2006/0186827 A1 * 8/2006 Ragonesi et al. ..... 315/185 S
2008/0054815 A1 * 3/2008 Kotikalapoodi et al. ..... 315/192

FOREIGN PATENT DOCUMENTS

WO WO 2007071033 A1 * 6/2007

* cited by examiner

*Primary Examiner* — Amare Mengistu
*Assistant Examiner* — Stacy Khoo
(74) *Attorney, Agent, or Firm* — J.C. Patents

(57) ABSTRACT

A circuit and a method for driving light emitting diodes (LEDs) are provided. First, an input voltage is converted into an output voltage and the output voltage is transmitted to the anode terminals of LED strings. The output voltage is reduced when the output voltage is greater than a first threshold voltage and the output voltage is reduced when the lowest level among the cathode terminal voltages of all the LED strings is greater than a second threshold voltage. Thus, the output voltage can be maintained at a lower level for driving all the LED strings to reduce unnecessary power wastage.

20 Claims, 7 Drawing Sheets

CIRCUIT AND METHOD FOR DRIVING LIGHT EMITTING DIODES

CROSS-REFERENCE TO RELATED APPLICATION

This application claims the priority benefit of Taiwan application serial no. 97105789, filed on Feb. 19, 2008. The entirety of the above-mentioned patent application is hereby incorporated by reference herein and made a part of this specification.

BACKGROUND OF THE INVENTION

1. Field of the Invention

The present invention generally relates to a circuit for driving a light emitting diode (LED), and more particularly, to a circuit and a method for driving light emitting diode strings (LED strings).

2. Description of Related Art

Due to advantages of electricity-saving and a fast switching speed, the applications of LEDs are much broader today than before where they were used as status lights for electronic devices in the earliest application, later advanced to serve as a backlight of an LCD and further advanced to serve as an electronic lighting and public display, such as vehicle light, traffic light, moving message board, large-scale video wall and even lighting inside a projector. After a high-end handset adopts LEDs as the backlight source thereof, LEDs have entered another new application field. The most potential application for LEDs is the market of 7-40 inch flat panel display. Once LEDs become a backlight source of plat panel display, a significant increase in production value on the market is expected.

The LEDs applied in the above-mentioned various products include a plurality of LEDs connected in series and parallel. Since the conducting voltage of each LED on a driving circuit employing a plurality of LEDs connected in series and parallel may differ from each other, the conventional scheme to prevent the conducting voltage of an LED string from being excessively high to fail lighting is to preset the output voltage of the driving circuit at a higher level.

FIG. 1 is a diagram of a conventional driving circuit for a plurality of LEDs. It can be seen from FIG. 1, the output voltage VOUT of the circuit is determined by feedback resistors R1 and R2, wherein the output voltage VOUT needs to be at least greater than the highest level among the conducting voltages required by each of LED strings SL1-SLN plus the lowest voltage required by the current source in the driving circuit so that the output voltage is sufficient to make all the LED strings SL1-SLN emit light (conducted).

Although the above-mentioned circuit of FIG. 1 can employ a voltage source (with an output voltage VOUT) to drive each of the LED strings SL1-SLN; however, each LED in the LED strings SL1-SLN would produce different conducting voltage due to a process nonconformance thereof. Therefore, in order to drive all the LEDs, the prior art presets the output voltage OUT at a higher level to prevent any LED string with a greater conducting voltage from failing to light. Nevertheless, the scheme of presetting the output voltage VOUT at a higher level would make the current source 101 applied by a greater voltage drop, which would lower the energy conversion efficiency and consume more power.

SUMMARY OF THE INVENTION

Accordingly, the present invention is directed to a circuit and a method for driving LEDs so as to promote the energy conversion efficiency and reduce the unnecessary power consumption caused by a conducting voltage variation of each LED.

The present invention is directed to a circuit and a method for driving an LED, wherein the driving voltage level are adjusted according to the conducting voltage of the LED so as to reduce the power consumption of the driving circuit.

As embodied and broadly described herein, the present invention provides a circuit for driving an LED. The circuit includes a converting circuit, a first control circuit and a second control circuit. The converting circuit converts an input voltage into an output voltage, provides the output voltage to the anode of the LED and reduces the output voltage according to a control signal. The first control circuit enables the control signal when the output voltage is greater than a first threshold voltage. The second control circuit enables the control signal when the cathode voltage of the LED is greater than a second threshold voltage.

The present invention further provides a circuit for driving a plurality of LEDs. The circuit includes a converting circuit, a first control circuit and a second control circuit. The converting circuit converts an input voltage into an output voltage and provides the output voltage to the anode of the LED, wherein when a control signal is enabled, the output voltage is reduced. The first control circuit enables the control signal when the output voltage is greater than a first threshold voltage. The second control circuit enables the control signal when the lowest level among all the cathode voltages of all the LEDs is greater than a second threshold voltage.

The present invention further provides a circuit for driving a plurality of LED strings, wherein each LED string is formed by a plurality of LEDs connected in series. The circuit includes a converting circuit, a first control circuit and a second control circuit. The converting circuit converts an input voltage into an output voltage and provides the output voltage to a first terminal of each LED string, wherein when a control signal is enabled, the output voltage is reduced. The first control circuit enables the control signal when the output voltage is greater than a first threshold voltage. The second control circuit enables the control signal when the lowest level among the second terminal voltages of all the LED strings is greater than a second threshold voltage.

The present invention further provides a method for driving a plurality of LED strings, wherein each LED string is formed by a plurality of LEDs connected in series. The method includes: converting an input voltage into an output voltage and providing the output voltage to the first terminals of all the LED strings, wherein the output voltage is reduced when a control signal is enabled; the control signal is enabled when the output voltage is greater than a first threshold voltage; and the control signal is enabled when the lowest level among the second terminal voltages of all the LED strings is greater than a second threshold voltage.

The present invention judges whether the output voltage is excessively high and thereby adjusts the output voltage to a minimum voltage required for driving every LED according to the cathode voltages of the LEDs, so as to reduce the unnecessary power consumption. In this manner, the circuit of the present invention is able to reduce unnecessary power consumption caused by a conducting voltage variation of each LED and promote the power conversion efficiency of the driving circuit.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
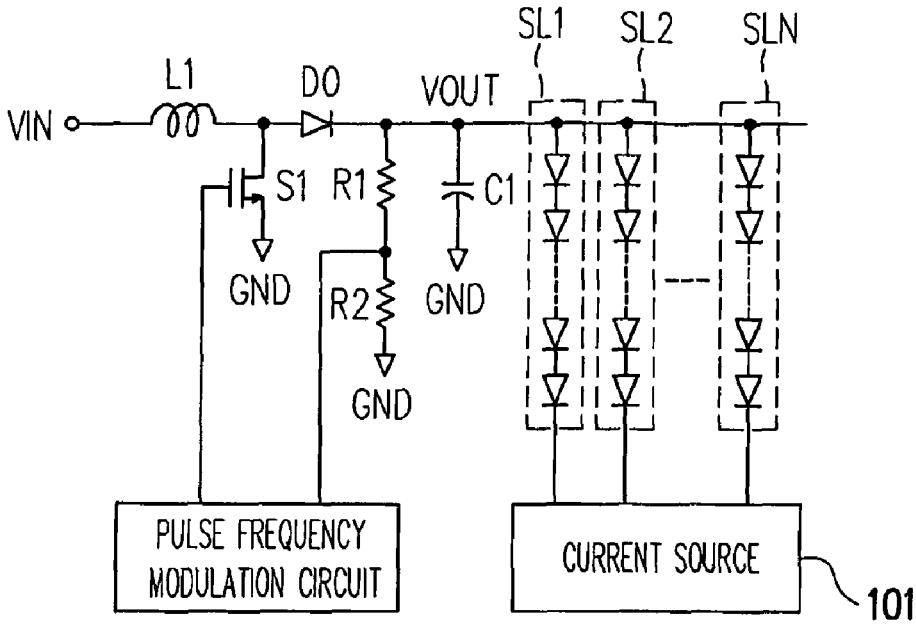
FIG. 1 is a diagram of a conventional driving circuit for a plurality of LEDs.

Reference will now be made in detail to the present preferred embodiments of the invention, examples of which are illustrated in the accompanying drawings. Wherever possible, the same reference numbers are used in the drawings and the description to refer to the same or like parts.

Figure 2:
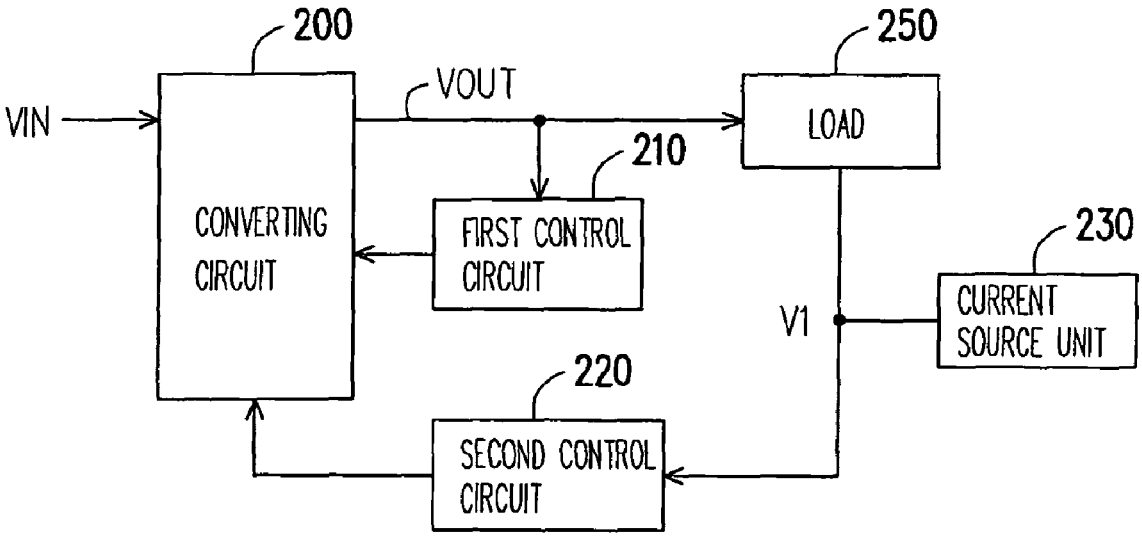
FIG. 2 is a block diagram of a circuit for driving LEDs according to an embodiment of the present invention.

FIG. 2 is a block diagram of a circuit for driving LEDs according to an embodiment of the present invention. The circuit includes a converting circuit 200, a first control circuit 210, a second control circuit 220, a current source unit 230 and a load 250. The converting circuit 200 converts an input voltage VIN into an output voltage VOUT provided to the load 250 and adjusts the output voltage VOUT according to the voltage drop between the load 250 and the current source unit 230. The load 250 is coupled between the output voltage VOUT and the current source unit 230, so as to make a voltage drop between the current source unit 230 and the load 250 when the output voltage VOUT is excessively high. In the present embodiment, the load 250 can be a backlight source formed by LEDs, a single LED, a plurality of LEDs or a plurality of LED strings.

The first control circuit 210 is coupled between the converting circuit 200 and the output voltage VOUT and enables a control signal for the converting circuit 200 to reduce the output voltage VOUT when the output voltage VOUT is greater than a first threshold voltage. The second control circuit 220 is coupled between the cathode terminal of the load 250 and the converting circuit 200 and enables the above-mentioned control signal for the converting circuit 200 to reduce the output voltage VOUT when the voltage drop between the load 250 and the current source unit 230 is greater than a second threshold voltage. The current source unit 230 is coupled to the cathode terminal of the load 250 for accepting and tolerating a redundant voltage drop and restricting the current passing through the load 250 so as to protect the load 250.

Figure 3:
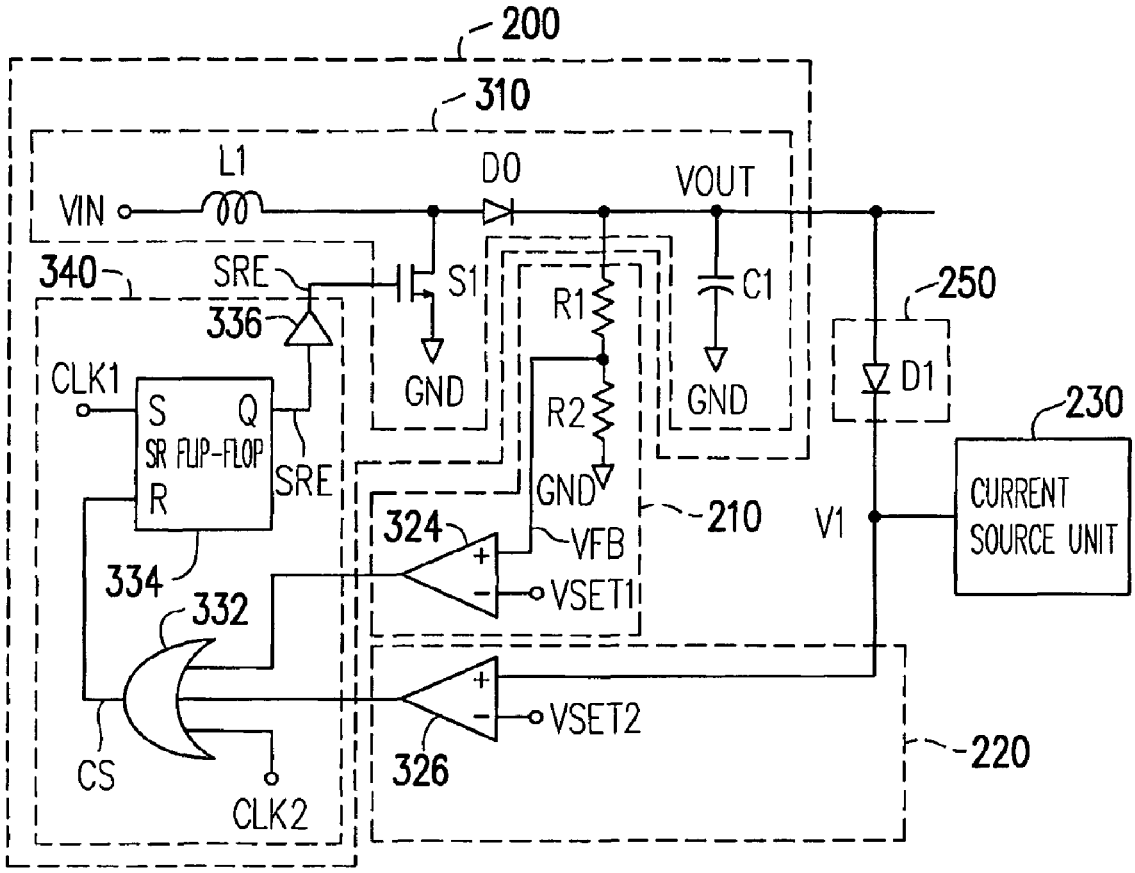
FIG. 3 is a driving circuit diagram according to the embodiment of FIG. 2.

FIG. 3 is a driving circuit diagram according to the embodiment of FIG. 2. Referring to FIG. 3, the driving circuit includes a converting circuit 200, a first control circuit 210 and a second control circuit 220, wherein the converting circuit 200 includes a boost circuit 310 and a pulse frequency modulation unit (PFM unit) 340. The PFM unit 340 includes an OR gate 332, an SR flip-flop 334 and a buffer 336. The first control circuit 210 is formed by resistors R1 and R2 and a comparator 324, while the second control circuit 220 is formed by a comparator 326. The boost circuit 310 converts an input voltage VIN into an output voltage VOUT and provides the output voltage VOUT to the anode of an LED D1 for driving the LED D1. When the output voltage VOUT is excessively high, the OR gate 332 enables a control signal CS to reduce the output voltage VOUT according to the outputs of the first control circuit 210 and the second control circuit 220.

The OR gate 332 outputs the control signal CS to the resetting terminal R of the SR flip-flop 334 according to a second clock signal CLK2 and the outputs of the first comparator 324 and the second comparator 326. The setting terminal S of the SR flip-flop 334 is coupled to a first clock signal CLK1, while the output terminal Q thereof outputs an adjustment signal SRE. The buffer 336 is coupled between the output terminal Q of the SR flip-flop 334 and the control terminal (gate) of a switch S1 in the boost circuit 310 for enhancing the driving ability of the adjustment signal SRE. During the circuit operation, if the output voltage VOUT is excessively high, the first control circuit 210 and the second control circuit 220 would enable the control signal CS, so that the adjustment signal SRE is able to cause an effect of pulse shielding and thereby the closing time of the switch S1 is lengthened to reduce the output voltage VOUT.

In more detail, when the output voltage VOUT is greater than the first threshold voltage, the first control circuit enables the control signal CS to reduce the output voltage VOUT; when the cathode voltage of the LED D1 is greater than the second threshold voltage, the second control circuit enables the control signal CS to reduce the output voltage VOUT, wherein the first threshold voltage and the second threshold voltage are defined by the user according to the design requirement.

Figure 4:
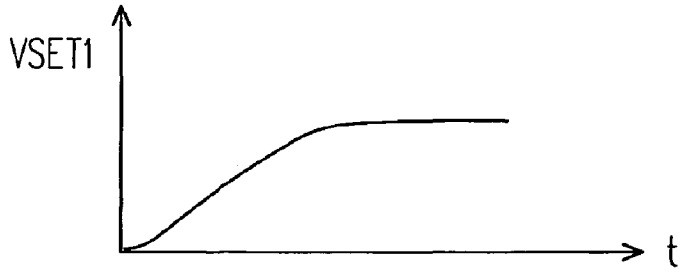
FIG. 4 is a waveform diagram of a first preset voltage according to the embodiment of the present invention.

The circuit architecture and the operations thereof of the present embodiment are further described hereinafter. The first control circuit 210 includes resistors R1 and R2 and a first comparator 324. The resistors R1 and R2 are connected in series to each other and coupled between the output voltage VOUT and a grounded terminal GND, and thereby divide the output voltage VOUT for producing a feedback voltage VFB. The positive input terminal and the negative input terminal of the first comparator 324 are respectively coupled to the feedback voltage VFB and a first preset voltage VSET1, while the output terminal thereof is coupled to an input terminal of the OR gate 332. The first preset voltage VSET1 has a waveform shown by FIG. 4, and once the power is turned on, the first preset voltage VSET1 would rises to a preset constant value in a period of time. Accordingly, the rising speed of the output voltage VOUT would be restricted by the first preset voltage VSET1 so that an excessive boosting speed to damage the load terminal circuit can be avoided. The user can adjust the maximum voltage value and the rising speed of the first preset voltage VSET1 according to the practical need.

When the feedback voltage VFB is greater than the first preset voltage VSET1, the first control circuit 210 enables the control signal CS to reduce the output voltage VOUT. Since the feedback voltage VFB is produced by dividing the output voltage VOUT, thus when the feedback voltage VFB is greater than the first preset voltage VSET1, it indicates the output voltage VOUT is greater than the first threshold voltage, wherein the first threshold voltage corresponds to the first preset voltage VSET1 and the first preset voltage VSET1 is related to the resistors R1 and R2. In other words, the first threshold voltage is determined by the feedback voltage VFB and the setting values of the resistors R1 and R2. Those skilled in the art would be able to derive the relationship between the first threshold voltage and the first preset voltage VSET1, and detail description thereof is omitted herein for simplicity.

The second control circuit 220 includes a second comparator 326. The positive input terminal and the negative input terminal of the second control circuit 220 are respectively coupled to the cathode voltage V1 of the LED D1 and a second preset voltage VSET2, while the output terminal of the second control circuit 220 is coupled to an input terminal of the OR gate 332. When the voltage drop between the LED D1 and a current source unit 230 (namely the cathode voltage V1 of the LED D1) is greater than the second preset voltage VSET2, the second control circuit 220 enables the control signal CS to reduce the output voltage VOUT, wherein the second preset voltage VSET2 represents the second threshold voltage.

The PFM unit 340 includes the OR gate 332, the SR flip-flop 334 and the buffer 336. The input terminals of the OR gate 332 are respectively coupled to the output terminal of the first comparator 324, the output terminal of the second comparator 326 and the second clock signal CLK2. The output terminal of the OR gate 332 outputs the control signal CS to the resetting terminal R of the SR flip-flop 334 according to the second clock signal CLK2 and the outputs of the first comparator 324 and the second comparator 326. Once the resetting terminal R of the SR flip-flop 334 receives the control signal CS (logic high level), the SR flip-flop performs a reset operation to make the adjustment signal SRE cause an effect of pulse shielding and to output the adjustment signal SRE from the output terminal Q thereof.

Figure 5A:
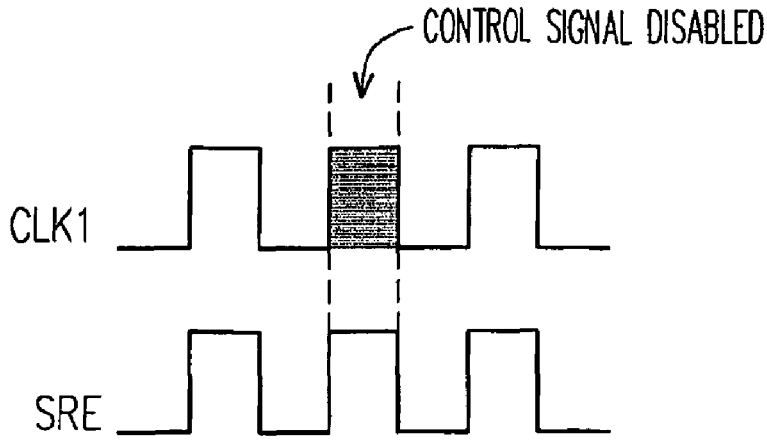
FIG. 5A is a diagram showing a first clock signal waveform and an adjustment signal waveform according to the embodiment of the present invention (corresponding to a disabled control signal).
Figure 5B:
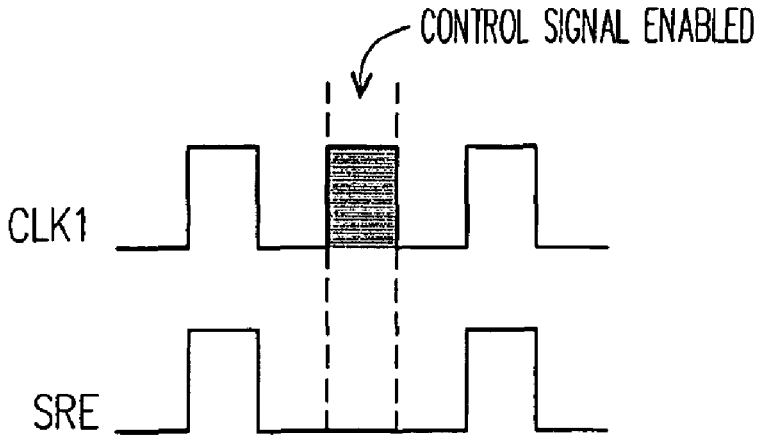
FIG. 5B is a diagram showing a first clock signal waveform and an adjustment signal waveform according to the embodiment of the present invention (corresponding to an enabled control signal).

The first clock signal CLK1 and the adjustment signal SRE of the SR flip-flop 334 have a relationship as shown by FIGS. 5A and 5B. In FIG. 5A, the control signal CS is disabled (lower voltage level) and the adjustment signal SRE has a waveform similar to that of the first clock signal CLK1; in FIG. 5B, the control signal CS is enabled (logic high level), which makes the waveform of the adjustment signal SRE shielded by at least a pulse. At this point, the adjustment signal SRE is output from the buffer 336 to the control terminal (gate) of the switch S1 in the boost circuit 310. Since the adjustment signal SRE herein causes an effect of pulse shielding (as shown by FIG. 5B) and the duration of the lower voltage level of the adjustment signal SRE is increased, the closing duration of the switch S1 is lengthened, which results in a reduced output voltage VOUT.

Figure 6:
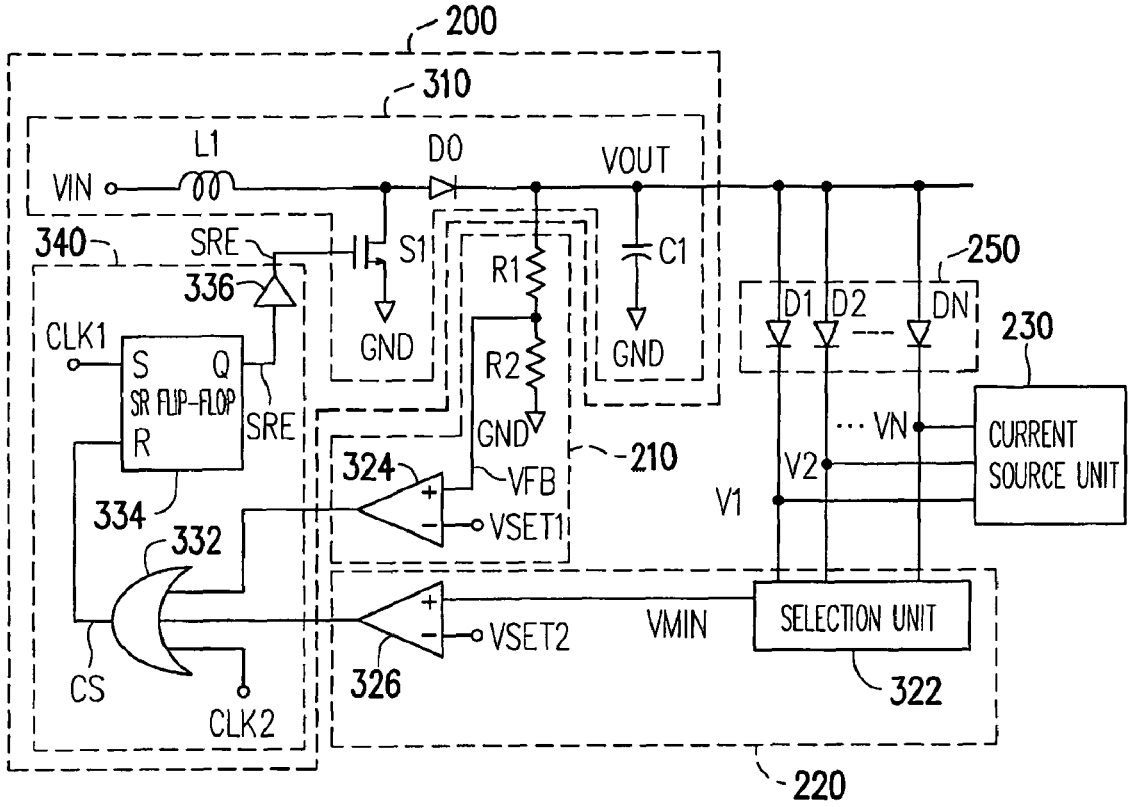
FIG. 6 is another driving circuit diagram according to the embodiment of FIG. 2.

FIG. 6 is another driving circuit diagram according to the embodiment of FIG. 2. Referring to FIG. 6, the driving circuit includes a converting circuit 200, a first control circuit 210 and a second control circuit 220, wherein the converting circuit 200 includes a boost circuit 310 and a pulse frequency modulation unit (PFM unit) 340. The first control circuit 210 is the same as shown FIG. 3, and description thereof is omitted herein for simplicity. The second control circuit 220 is formed by a selection unit 322 and a second comparator 326. The boost circuit 310 converts the input voltage VIN into an output voltage VOUT and provides the output voltage VOUT to the anodes of LEDs D1-DN for driving the LEDs D1-DN. When the output voltage VOUT is excessively high, the OR gate 332 enables a control signal CS to reduce the output voltage VOUT according to the outputs of the first control circuit 210 and the second control circuit 220. The method of reducing the output voltage VOUT is similar to that described with reference to FIG. 3 and it is omitted herein for simplicity.

In the following, the circuit architecture and the operation detail of the embodiment of the present invention are further described, wherein the architecture and the operation of the first control circuit 210 are the same as shown in FIG. 3 and the description thereof is omitted herein for simplicity.

The second control circuit 220 includes a selection unit 322 and a second comparator 326. The selection unit 322 is coupled between the cathode terminals of the LEDs D1-DN and the second comparator 326 for selecting and outputting the lowest voltage level VMIN among all the voltage drops between the LEDs DL-DN and the current source unit 230 (namely among all the cathode voltages V1-VN of the LEDs D1-DN). The positive input terminal and the negative input terminal of the second comparator 326 are respectively coupled to the selection unit 322 and the second preset voltage VSET2, while the output terminal thereof is coupled to an input terminal of the OR gate 332. When the lowest voltage level VMIN output from the selection unit 322 is greater than the second preset voltage VSET2, the second control circuit 220 enables the control signal CS to reduce the output voltage VOUT. The operation flowchart of reducing the output voltage VOUT is the same as FIG. 3 and it is omitted herein for simplicity.

Figure 7:
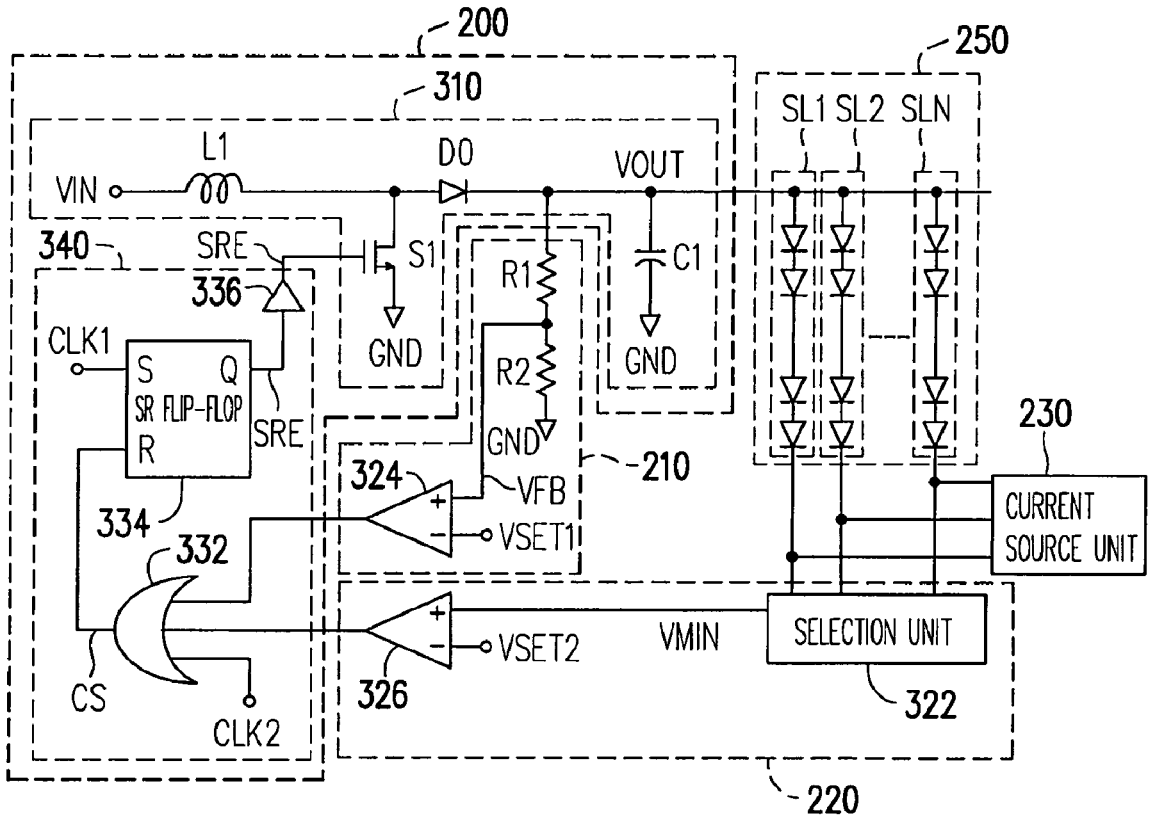
FIG. 7 is yet another driving circuit diagram according to the embodiment of FIG. 2.

FIG. 7 is yet another driving circuit diagram according to the embodiment of FIG. 2. Referring to FIG. 7, the driving circuit includes a converting circuit 200, a first control circuit 210 and a second control circuit 220, wherein the converting circuit 200 includes a boost circuit 310 and a pulse frequency modulation unit (PFM unit) 340. The first control circuit 210 and the second control circuit 220 are the same as shown in FIG. 3, which are omitted herein for simplicity. The boost circuit 310 converts the input voltage VIN into an output voltage VOUT and provides the output voltage VOUT to the first terminals of LED strings SL1-SLN (namely the anode terminals of all the LED strings SL1-SLN) for driving the LED strings SL1-SLN. When the output voltage VOUT is excessively high, the OR gate 332 enables a control signal CS to reduce the output voltage VOUT according to the outputs of the first control circuit 210 and the second control circuit 220. The method of reducing the output voltage VOUT is similar to that described with reference to FIG. 3 and it is omitted herein for simplicity.

The circuit architecture and the operation detail of the embodiment of the present invention are described hereinafter. The architecture and the operation of the first control circuit 210 are the same as described with reference to FIG. 3 and they are omitted herein for simplicity. The second control circuit 220 includes a selection unit 322 and a second comparator 326. The selection unit 322 is coupled between the second terminals of the LED strings SL1-SLN (namely the cathode terminals of the LED strings SL1-SLN) and the second comparator 326 for selecting and outputting the lowest voltage level VMIN among all the second terminal voltages VSL1-VSLN of the LED strings SL1-SLN. The positive input terminal and the negative input terminal of the second comparator 326 are respectively coupled to the selection unit 322 and the second preset voltage VSET2, while the output terminal thereof is coupled to an input terminal of the OR gate 332. When the lowest voltage level VMIN output from the selection unit 322 is greater than the second preset voltage VSET2, the second control circuit 220 enables the control signal CS to reduce the output voltage VOUT. The operation flowchart of reducing the output voltage VOUT is the same as described with reference to FIG. 3 and it is omitted herein for simplicity.

Figure 8:
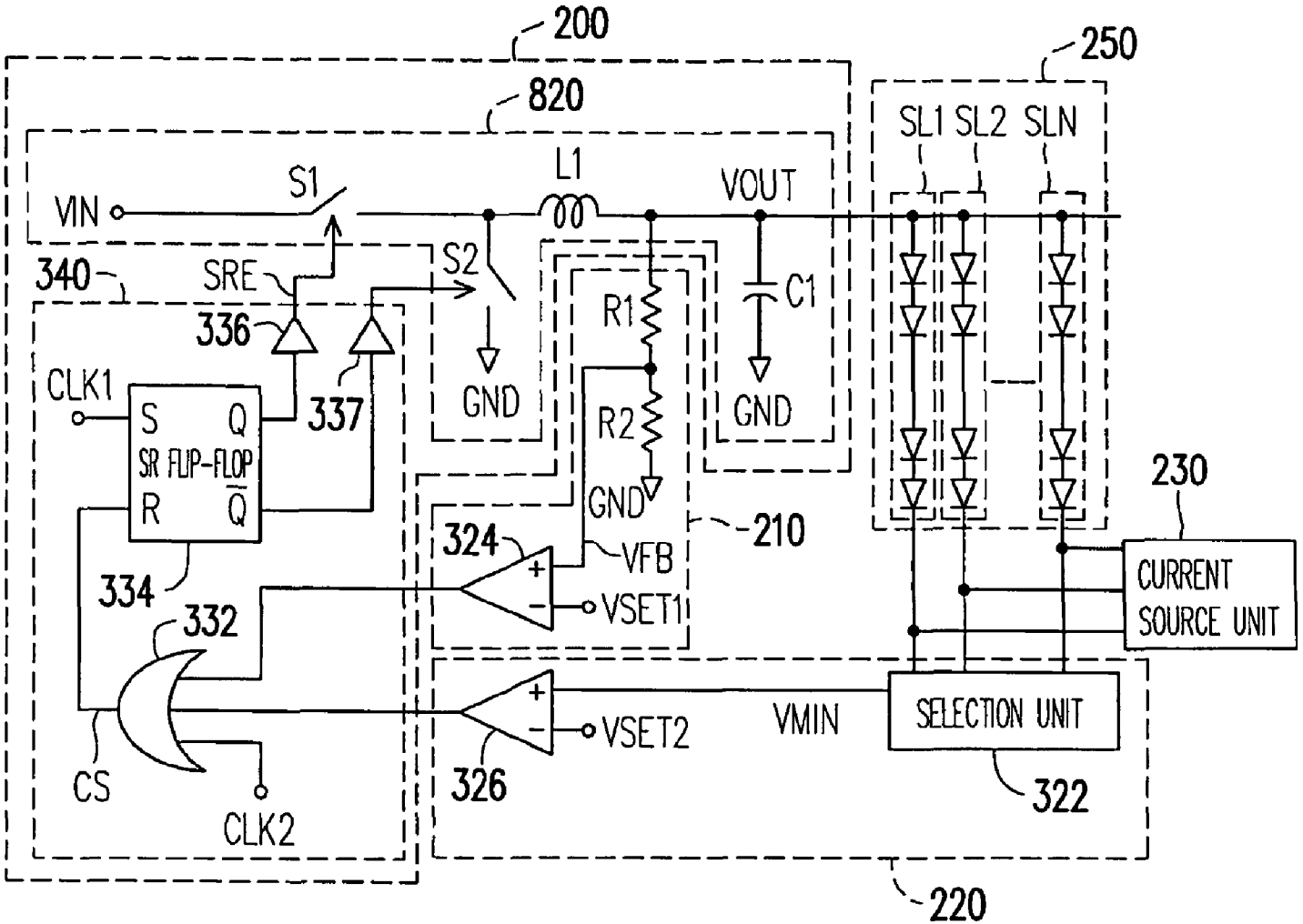
FIG. 8 is a modified driving circuit diagram of FIG. 7.

Those skilled in the art would know that the boost circuit 310 in the above-mentioned embodiment could be implemented by a buck circuit 820 as well, as shown in FIG. 8.

FIG. 8 is a modified driving circuit diagram of FIG. 7. FIG. 8 is similar to FIG. 7 except that the boost circuit 310 in FIG. 7 is replaced by a buck circuit 820 in FIG. 8. Switches S1 and S2 in FIG. 8 are complementary to each other (the switch S1 is coupled to the forward output terminal Q of an SR flip-flop 334 via a buffer 336), while the switch S2 is coupled to the inverted output terminal Q of the SR flip-flop 334 via a buffer 337. Therefore, when the switch S1 is turned on, the switch is turned off. In other words, when the switch S1 is turned off, the switch S2 is turned on.

When the conducting duration of the switch S1 is longer than the conducting duration of the switch S2, the level of the output voltage VOUT of the driving circuit is increased; when the conducting duration of the switch S1 is shorter than the conducting duration of the switch S2, the level of the output voltage VOUT is decreased. Thus, whenever the output voltage VOUT is excessively high, a first control circuit 210 or a second control circuit 220 enables a control signal CS and sends the control signal CS to the resetting terminal R of the SR flip-flop 334, so that the SR flip-flop performs a resetting operation to make an adjustment signal SRE cause an effect of pulse shielding, which shortens the conducting duration of the switch S1 to reduce the output voltage VOUT.

Those skilled in the art would understand that the resistors coupled between the output voltage VOUT and a grounded terminal GND are not limited to only two resistors connected in series. In fact, the number of the resistors can be three or more depending on the actual requirement.

Compared to the conventional circuit, the output voltage VOUT is adjusted by the first control circuit 210 and the second control circuit 220 in the circuit of the above-mentioned embodiment. When the output voltage VOUT is excessively high, the first control circuit 210 and the second control circuit 220 enable the control signal CS to reduce the output voltage VOUT and maintain the output voltage VOUT at an optimum level (the level neither more nor less than a voltage for conducting all the LED strings SL1-SLN). In addition, in order to conduct every LED string, the conventional circuit needs to set the output voltage VOUT at a higher level. Again compared to the conventional circuit, the embodiment implemented by the present invention is able to reduce energy consumption and reduce the problem caused by a variation of the conducting voltage of each LED.

Figure 9:
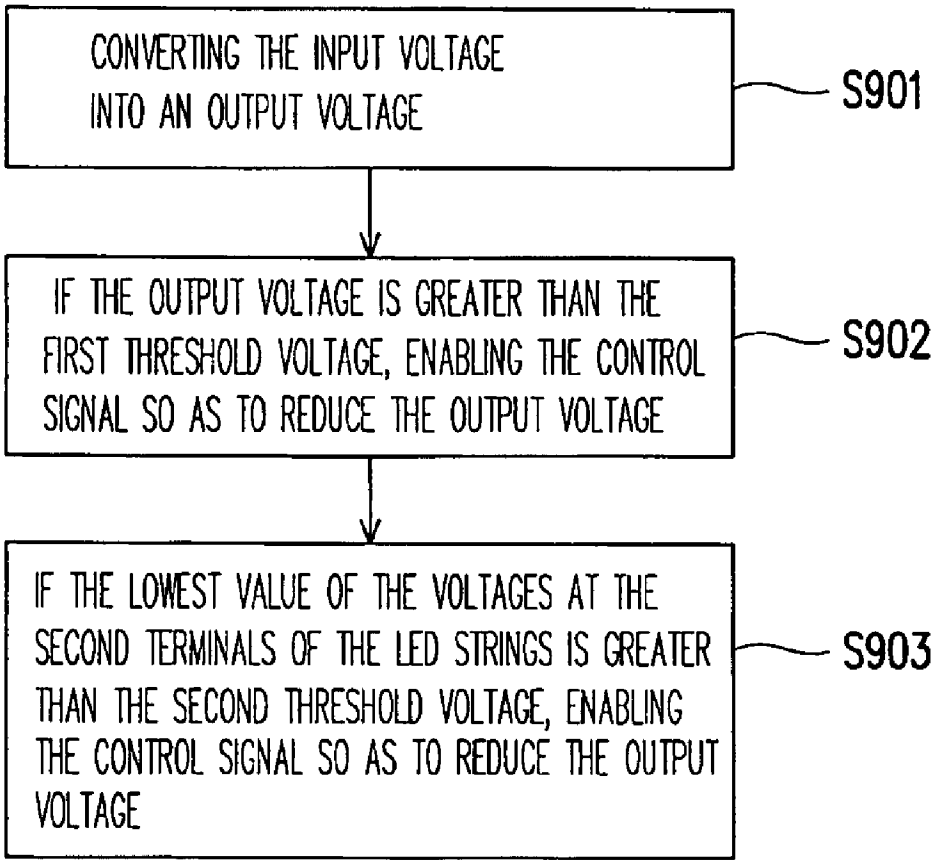
FIG. 9 is a flowchart of driving a plurality of LED strings according to an embodiment of the present invention.

FIG. 9 is a flowchart of driving a plurality of LED strings according to an embodiment of the present invention. Referring to FIG. 9, the method includes following steps. First, the input voltage on an input voltage VIN is converted into an output voltage (step S900). Next, the output voltage is divided by a plurality of resistors to produce a feedback voltage and the feedback voltage is input to a first comparator for judging whether the output voltage is greater than a first threshold voltage of the first comparator. When the output voltage is greater than the first threshold voltage, a control signal is enabled so as to reduce the output voltage (step S902).

Furthermore, the output voltage is provided to the first terminals of all the LED strings, and the second terminal voltages of all the LED strings are input to a selection unit for the selection unit to select the lowest voltage level among the second terminal voltages of all the LED strings. The selected lowest voltage level is input to a second comparator for judging whether the lowest voltage level is greater than a second threshold voltage of the second comparator. When the lowest voltage level is greater than the second threshold voltage, the control signal is enabled to reduce the output voltage (step S902).

It is noted that although the above embodiment has described a feasible method of driving LED strings and a feasible driving circuit using the same, while those skilled in the art would understand that the converting circuit 200, the first control circuit 210 and the second control circuit 220 provided by each manufacturer are different from those of the other manufacturers. Therefore, the present invention is not limited to the embodiments described hereinbefore. In other words, once a first control circuit 210 and a second control circuit are employed to detect the output voltage VOUT of a converting circuit 200, and when the detected output voltage VOUT is excessively high, a control signal is enabled to make the adjustment signal SRE of a PFM unit 340 cause an effect of pulse shielding to accordingly reduce the output voltage VOUT, the adopted method or circuit is within the scope of the present invention.

In summary, the present invention employs a first control circuit and a second control circuit to detect the output voltage of a converting circuit, adjusts the pulse frequency and the waveform of the clock signal in a PFM unit according to the output voltage level and further achieve the setting of the output voltage based on the adjustments of the pulse frequency and the waveform. In this way, the output voltage can be set at a minimum voltage level required for driving all the LEDs to reduce unnecessary power consumption. In addition, the circuit provided by the present invention can also reduce the phenomenon of power-wastage caused by a conducting voltage variation of each LED, therefore, the power conversion efficiency is effectively increased.

What is claimed is:

1. A circuit for driving a light emitting diode, comprising:

a converting circuit, for converting an input voltage to a output voltage applied to an anode of the light emitting diode, wherein a level of the output voltage is decreased when a control signal is enabled;

a first control circuit, for enabling the control signal when the level of the output voltage is higher than a first threshold; and a second control circuit, for enabling the control signal when a level of a voltage on a cathode of the light emitting diode is higher than a second threshold, wherein the converting circuit comprises:

a pulse frequency modulation unit, for outputting an adjustment signal according to a first clock signal and outputs of the first control circuit and the second control circuit; and a boost circuit or a buck circuit, for determining the level of the output voltage according to the adjustment signal.

2. The circuit of the claim 1, wherein the first control circuit comprises:

a first comparator, for enabling the control signal according to a first default voltage corresponding to the first threshold and a feedback voltage generated by means of resistors connected between the output voltage and a ground.

3. The circuit of the claim 1, wherein the second control circuit comprises:

a second comparator, for enabling the control signal according to a second default voltage corresponding to the second threshold and the voltage on the cathode of the light emitting diode.

4. The circuit of the claim 1, wherein the pulse frequency modulation unit comprises:

a gate, for outputting the control signal according to a second clock signal and the outputs of the first control circuit and the second control circuit; and a SR flip-flop, having a set terminal S of the SR flip-flop coupled to the first clock signal and a reset terminal R coupled to the control signal, and outputting the adjustment signal.

5. The circuit of the claim 4, wherein the pulse frequency modulation unit comprises:

a buffer, coupled between the boost circuit or the buck circuit and the output of the SR flip-flop.

6. A circuit for driving a plurality of light emitting diodes, comprising:

a converting circuit, for converting an input voltage to a output voltage applied to anodes of the light emitting diodes, wherein a level of the output voltage is decreased when a control signal is enabled;

a first control circuit, for enabling the control signal when the level of the output voltage is higher than a first threshold; and a second control circuit, for enabling the control signal when a level of a selected one of voltages on cathodes of the light emitting diodes is higher than a second threshold, wherein the converting circuit comprises:

a pulse frequency modulation unit, for outputting an adjustment signal according to a first clock signal and outputs of the first control circuit and the second control circuit; and a boost circuit or a buck circuit, for determining the level of the output voltage according to the adjustment signal.

7. The circuit of claim 6, wherein first control circuit comprises:

a first comparator, for enabling the control signal according to a first default voltage corresponding to the first threshold and a feedback voltage generated by means of resistors connected between the output voltage and a ground.

8. The circuit of claim 6, wherein second control circuit comprises:

a selection unit, for selecting and outputting the lowest one of voltages on cathodes of the light emitting diodes; and a second comparator, for enabling the control signal according to a second default voltage corresponding to the second threshold and an output of the selection unit.

9. The circuit of the claim 6, wherein the pulse frequency modulation unit comprises:

an OR gate, for outputting the control signal according to a second clock signal and the outputs of the first control circuit and the second control circuit; and a SR flip-flop, having a set terminal S of the SR flip-flop coupled to the first clock signal and a reset terminal R coupled to the control signal, and outputting the adjustment signal.

10. The circuit of the claim 9, wherein the pulse frequency modulation unit comprises:

a buffer, coupled between the boost circuit or the buck circuit and the output of the SR flip-flop.

11. The circuit of claim 6, wherein the selected voltage is the lowest one among those of the light emitting diodes.

12. A circuit for driving strings of light emitting diode, each of which has a plurality of light emitting diodes connected in series, the circuit comprising:

a converting circuit, for converting an input voltage to a output voltage applied to first ends of the strings, wherein a level of the output voltage is decreased when a control signal is asserted;

a first control circuit, for asserting the control signal when the level of the output voltage is higher than a first threshold; and a second control circuit, for asserting the control signal when a level of a selected one of voltages on second ends of the strings is higher than a second threshold, wherein the converting circuit comprises:

a pulse frequency modulation unit, for outputting an adjustment signal according to a first clock signal and the outputs of the first control circuit and the second control circuit; and a boost circuit or a buck circuit, for determining the level of the output voltage according to the adjustment signal.

13. The circuit of claim 12, wherein first control circuit comprises:

a first comparator, for asserting the control signal according to a first default voltage corresponding to the first threshold and a feedback voltage generated by means of resistors connected between the output voltage and a ground.

14. The circuit of claim 12, wherein the second control circuit comprises:

a selection unit, for selecting and outputting the lowest one of voltages on the second ends of the strings; and a second comparator, for asserting the control signal according to a second default voltage corresponding to the second threshold and the output of the selection unit.

15. The circuit of the claim 12, wherein the pulse frequency modulation unit comprises:

an OR gate, for outputting the control signal according to a second clock signal and the outputs of the first control circuit and the second control circuit; and a SR flip-flop, having a set terminal S of the SR flip-flop coupled to the first clock signal and a reset terminal R coupled to the control signal, and outputting the adjustment signal.

16. The circuit of the claim 15, wherein the pulse frequency modulation unit comprises:

a buffer, coupled between the boost circuit or the buck circuit and the output of the SR flip-flop.

17. The circuit of claim 12, wherein the selected voltage is the lowest one among those of the strings.

18. The circuit of claim 12, wherein second ends of the strings are cathodes of the strings of light emitting diode.

19. A method for driving strings of light emitting diode including a plurality of light emitting diodes connected in series, comprising:

converting an input voltage to a output voltage applied to first ends of the strings, wherein a level of the output voltage is decreased when a control signal is enabled;

enabling the control signal when the level of the output voltage is higher than a first threshold; and enabling the control signal when a level of a selected one of voltages on second ends of the strings is higher than a second threshold, wherein the step of converting the input voltage to the output voltage comprises:

outputting an adjustment signal according to a first clock signal, a first comparison between the level of the output voltage and the first threshold, and a second comparison between the level of the selected voltage and the second threshold; and determining the level of the output voltage according to the adjustment signal.

20. The method of claim 19, wherein the selected voltage is lowest one of those on cathodes of the strings of light emitting diode.

* * * * *